US010309087B2

(12) United States Patent
Hsu

(10) Patent No.: US 10,309,087 B2
(45) Date of Patent: Jun. 4, 2019

(54) STACKED TYPE QUANTITATIVE TOILET CLEANING AGENT DISPENSER

(71) Applicant: DONZEE ENTERPRISE LTD., Taichung (TW)

(72) Inventor: Jin-Yang Hsu, Taichung (TW)

(73) Assignee: Donzee Enterprise Ltd., Taichung (TW)

( * ) Notice: Subject to any disclaimer, the term of this patent is extended or adjusted under 35 U.S.C. 154(b) by 0 days.

(21) Appl. No.: 15/825,621

(22) Filed: Nov. 29, 2017

(65) Prior Publication Data

US 2018/0209128 A1 Jul. 26, 2018

(30) Foreign Application Priority Data

Jan. 24, 2017 (TW) ..... 106102597 A

(51) Int. Cl.
*E03D 9/03* (2006.01)
*E03D 9/02* (2006.01)
*E03D 9/00* (2006.01)

(52) U.S. Cl.
CPC ..... *E03D 9/038* (2013.01); *E03D 9/007* (2013.01); *E03D 2009/024* (2013.01)

(58) Field of Classification Search
CPC ..... E03D 9/033; E03D 9/038; E03D 9/036; E03D 9/037; E03D 9/035; E03D 9/007; E03D 2009/024
USPC ..... 4/227.1, 227.4, 227.5, 227.6, 222
See application file for complete search history.

(56) References Cited

U.S. PATENT DOCUMENTS 429,384 A * 6/1890 Manwaring ..... C02F 1/42 4/227.1
3,423,182 A * 1/1969 Klasky ..... E03D 9/038 222/424.5
3,715,765 A * 2/1973 Yadro ..... E03D 9/007 4/227.6
3,769,640 A * 11/1973 Castronovo ..... E03D 9/038 248/685
4,365,362 A * 12/1982 Corey ..... E03D 9/038 4/227.1
4,435,858 A * 3/1984 Dolan ..... E03D 9/038 4/227.6

(Continued)

FOREIGN PATENT DOCUMENTS

CN 2098526 U 3/1992
TW 344389 U 11/1998

*Primary Examiner* — Erin Deery
(74) *Attorney, Agent, or Firm* — Muncy, Geissler, Olds & Lowe, P.C.

(57) ABSTRACT

A stacked type quantitative toilet cleaning agent dispenser includes a housing, an inner box mounted in the housing and defining the housing a bottom chamber beneath the inner box and an aisle around the inner box and above the bottom chamber, and a cover covering the inner box and having a first water inlet in communication with the inside space of the inner box and a second water inlet. Further, the inner box has an open end tube that keeps the second water inlet in communication with the bottom chamber and isolated from the inner box. Further, the cover has a first water outlet below the elevation of the first water inlet. The aisle is disposed in communication with the space outside the housing via a second water outlet that is disposed below the elevation of the second water inlet.

14 Claims, 8 Drawing Sheets

(56) References Cited

U.S. PATENT DOCUMENTS

| | | | | |
|---|---|---|---|---|
| 5,774,903 | A * | 7/1998 | Wilson | E03D 9/038 4/227.1 |
| 8,806,668 | B2 * | 8/2014 | Lin | E03D 9/038 4/227.1 |
| 2011/0209277 | A1 * | 9/2011 | Liu | E03D 9/033 4/227.1 |

* cited by examiner

STACKED TYPE QUANTITATIVE TOILET CLEANING AGENT DISPENSER

BACKGROUND OF THE INVENTION

1. Field of the Invention

The present invention relates to toilet cleaning agent dispensing technology and more particularly, to a stacked type quantitative toilet cleaning agent dispenser.

2. Description of the Related Art

Generally, a household toilet cleaning agent is a solid block. When in use, it is put the toilet cleaning agent in the toilet water tank and dissolved in water. When the user flushes the toilet, the dissolved toilet cleaning agent forms a coating layer on the inner surface of the toilet bowl to prevent dirt and urine adhesion, maintaining the toilet cleaning. However, when the toilet cleaning agent is put in the toilet water tank and kept in contact with the water in the toilet water tank, it is continuously dissolved in water till that the toilet cleaning agent is completely dissolved out. However, when the toilet is being flushed continuously within a short time, the toilet cleaning agent is not well dissolved in water, thus, the toilet cleaning agent content in water will be insufficient, leading to a low toilet antifouling effect. On the contrary, if the toilet is not flushed for a considerable period of time, the toilet cleaning agent will be excessively dissolved water, thus, the concentration of toilet cleaning agent in water will be excessively high, resulting in waste of the toilet cleaning agent and causing pigment stains.

In view of the above-stated problems, Taiwan Patent Publication Number 344389 discloses a utility design; the utility design is to put a toilet cleaning agent in a shell inside the toilet water tank. Before flushing the toilet, the water in the toilet water tank flows through a water inlet in the top side of the shell into the inside of the shell. When the user flushes the toilet, the water level in the toilet water tank is lowered. Subject to the effect of liquid surface difference, a predetermined amount of toilet cleaning agent solution flows out of the shell through a water outlet that is disposed below the elevation of the water inlet, and the dispensed toilet cleaning agent solution is mixed in the flow of water that flows out of the toilet water tank into the toilet bowl. Thus, this design is adapted to solve the problem caused by unequal length of toilet cleaning agent dissolving time. However, according to this prior art utility design, the toilet cleaning agent can simply be dissolved in the limited amount of water in the shell between the water inlet and the water outlet by means of diffusion, thus, the toilet cleaning agent concentration in the dispensed water during each toilet flushing operation is insufficient, resulting in poor toilet cleaning effect.

Further, China Patent No. 2098526 discloses a measure of improving the problem of prior art designs that are unable to qualitatively and quantitatively dispense a toilet cleaning agent. According to this design, a container is provided with a water inlet on a cover thereof and a discharge hole on the periphery thereof, and a funnel-shaped quantitative release port is located at the bottom side of the cover for flipping the detergent that is deposited on the bottom of the container so as to achieve the effect of quantitative dispensing of toilet cleaning agent. However, if the toilet cleaning agent is a fluid, it does not need to flip the deposition. If the toilet cleaning agent is a solid material, the water outlet at the bottom side of the container will be blocked by the solid toilet cleaning agent and prohibited from discharging water. If the toilet cleaning agent is made in granules or flakes, the toilet cleaning agent will be dissolved to form a toilet cleaning solution with a dilute layer in the upper side and a thick layer in the lower side, at this time, the water outlet in the bottom side of the container can be clogged by the thick layer of toilet cleaning solution. Further, this prior art utility design simply provides one accommodation chamber for accommodating a toilet cleaning agent, it has no room for accommodating other chemicals (such as fragrance compound or deodorant).

In general, the aforesaid toilet cleaning agent dispensing techniques still have drawbacks and need to improve.

SUMMARY OF THE INVENTION

The present invention has been accomplished under the circumstances in view. It is the main object of the present invention to provide a stacked type quantitative toilet cleaning agent dispenser, which provides two or more accommodation spaces for the filling of the toilet cleaning agent and other chemicals, enabling each agent or chemical to be dispensed quantitatively.

To achieve this and other objects of the present invention, a stacked type quantitative toilet cleaning agent dispenser comprises a housing, an inner box and a cover. The housing is shaped like a barrel having an open top side and an opposing closed bottom side for positioning on a surface. The inner box is mounted in the housing in such a manner that a bottom chamber is defined within the housing between an outer bottom surface of the inner box and an inner bottom surface of the housing, and an aisle is defined between an inner perimeter of the housing and an outer perimeter of the inner box and disposed in communication with the bottom chamber. The cover covers the inner box with a top thereof exposed on the outside of the housing. Further, the cover comprises a first water inlet and a second water inlet. The first water inlet is disposed in communication with the space inside the inner box. The inner box comprises an open end tube. The open end tube has one end thereof connected to the cover and disposed in communication with the second water inlet, and an opposite end thereof inserted through the inner box and disposed in communication with the bottom chamber to keep the second water inlet and the bottom chamber in communication with each other and to isolate the second water inlet and the bottom chamber from the inner box. The stacked type quantitative toilet cleaning agent dispenser further comprises a first water outlet located in the cover and the inner box for allowing communication between the space inside the inner box and the space outside the inner box. The first water outlet is disposed below the elevation of the first water inlet. The aisle is disposed in communication with the space outside the housing through a second water outlet. The second water outlet is disposed below the elevation of the second water inlet.

Thus, the invention provides two or more accommodation spaces for the filling of the toilet cleaning agent and other chemicals, enabling each agent or chemical to be dispensed quantitatively.

Other advantages and features of the present invention will be fully understood by reference to the following specification in conjunction with the accompanying drawings, in which like reference signs denote like components of structure.

DETAILED DESCRIPTION OF THE INVENTION

Figure 1:
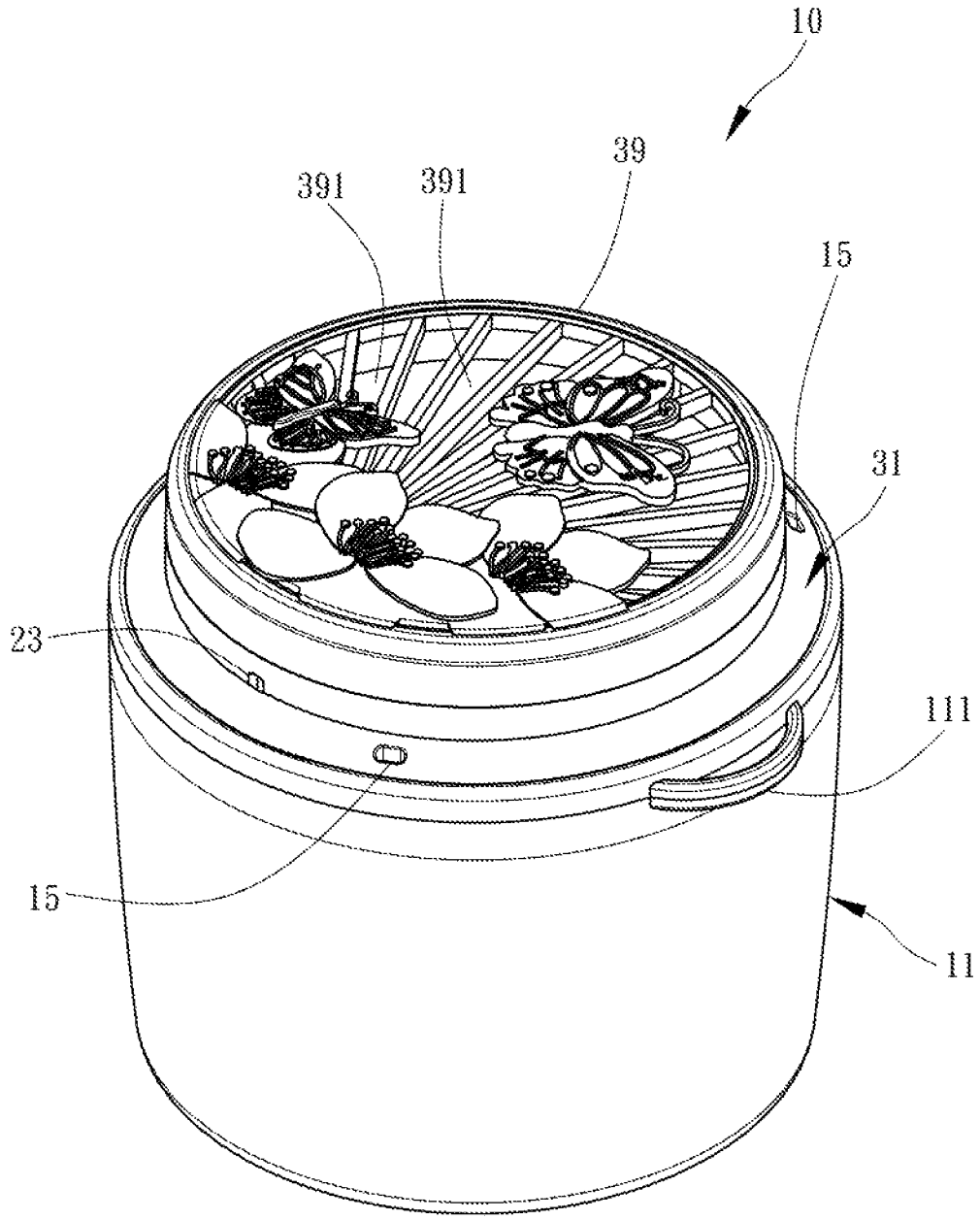
FIG. 1 is an oblique top elevational view of a stacked type quantitative toilet cleaning agent dispenser in accordance with a first embodiment of the present invention.
Figure 2:
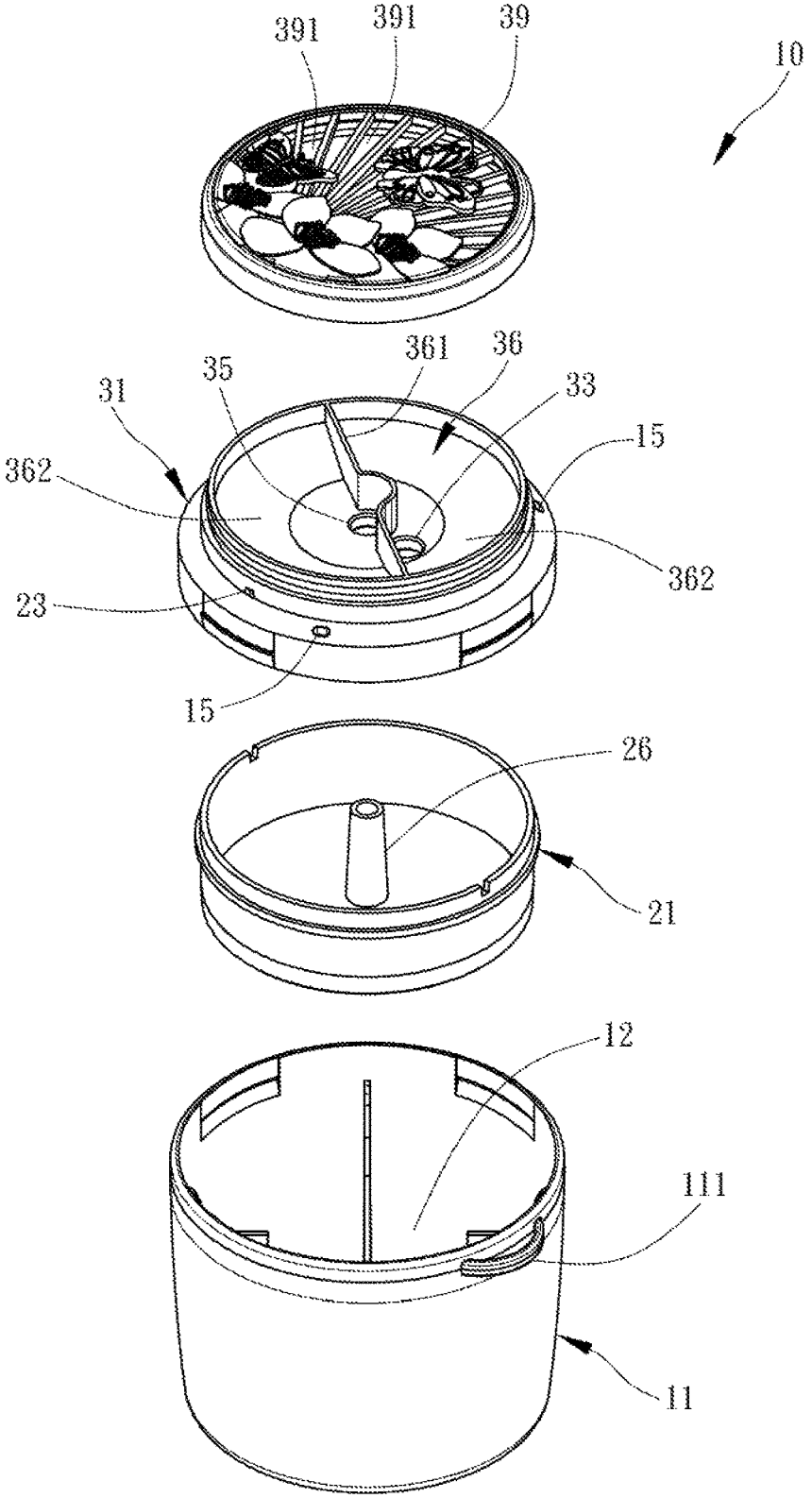
FIG. 2 is an exploded view of the stacked type quantitative toilet cleaning agent dispenser in accordance with the first embodiment of the present invention.
Figure 3:
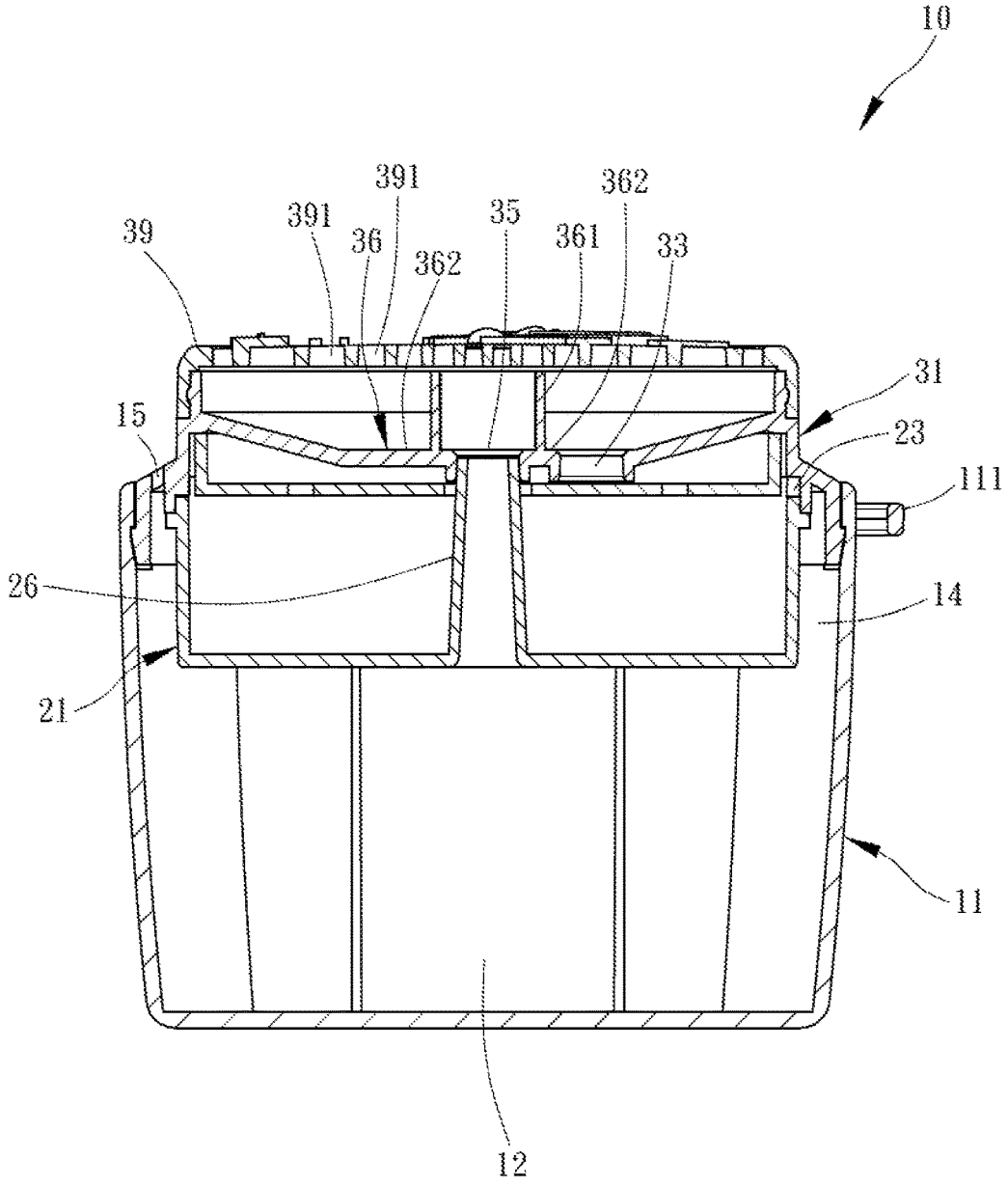
FIG. 3 is a schematic sectional view of the stacked type quantitative toilet cleaning agent dispenser in accordance with the first embodiment of the present invention.

Referring to FIGS. 1-3, a stacked type quantitative toilet cleaning agent dispenser 10 in accordance with a first embodiment of the present invention is shown. The stacked type quantitative toilet cleaning agent dispenser 10 comprises a housing 11, an inner box 21 and a cover 31.

The housing 11 is shaped like a barrel having an open top side and an opposing closed bottom side for positioning on a surface (for example, the inner bottom surface of a toilet water tank).

The inner box 21 is mounted in the housing 11 in such a manner that a bottom chamber 12 is defined within the housing 11 between an outer bottom surface of the inner box 21 and an inner bottom surface of the housing 11 and an aisle 14 is defined between the inner perimeter of the housing 11 and the outer perimeter of the inner box 21 and disposed in communication with the bottom chamber 12.

The cover 31 covers the inner box 21 with the top thereof exposed on the outside of the housing 11. The cover 31 comprises a first water inlet 33 and a second water inlet 35. The first water inlet 33 is disposed in communication with the space inside the inner box 21.

Further, the inner box 21 comprises an open end tube 26. The open end tube 26 has one end thereof connected to the cover 31 and kept in communication with the second water inlet 35, and an opposite end thereof inserted through the inner box 21 and disposed in communication with the bottom chamber 12, thus, the second water inlet 35 is kept in communication with the bottom chamber 12 but not disposed in communication with the inner box 21.

Further, a first water outlet 23 is located in the cover 31 and the inner box 21 for allowing communication between the space inside the inner box 21 and the space outside the inner box 21. Further, the first water outlet 23 is disposed below the elevation of the first water inlet 33. In the present first embodiment of the present invention, the first water outlet 23 is located in the cover 31, however, in actual application, the first water outlet 23 can be located in the peripheral wall of the inner box 21, but this is only a change in the location, it can be directly understood by the text, and therefore we do not show it schematically.

Further, the aisle 14 is disposed in communication with the space outside the housing 11 through a second water outlet 15. This second water outlet 15 is disposed below the elevation of the second water inlet 35.

In this first embodiment of the present invention, instead of covering over the inner box 21, the cover 31 can be configured to cover the top open side of the housing 11. In this case, the second water outlet 15 is located in the cover 31. The cover 31 further comprises a recess 36 inwardly curved from a top surface thereof. The first water inlet 33 and the second water inlet 35 are respectively located in a bottom wall of the recess 36. The cover 31 further comprises a partition plate 361 located on the top surface of the bottom wall of the recess 36 and dividing the recess 36 into two sub-recesses 362 that are respectively disposed corresponding to the first water inlet 33 and the second water inlet 35. These two sub-recesses 362 are isolated from each other. In actual application, the cover 31 can be configured without the aforesaid recess 36 and partition plate 361, allowing the first water inlet 33 and the second water inlet 35 to admit water. The arrangement of the recess 36 and the partition plate 361 can effectively guide water from the recess 36 into the first water inlet 33 and the second water inlet 35. Further, the arrangement of the partition plate 361 can achieve the effect of water control.

In the first embodiment of the present invention, the stacked type quantitative toilet cleaning agent dispenser 10 further comprises a decorative lid 39 covered on the cover 31. The decorative lid 39 has a plurality of openings 391 for allowing water to pass therethrough to the cover 31. Further, the housing 11 comprises a mounting portion 111 located at the periphery thereof for the mounting of a cord member 98 (see FIG. 5).

After understanding of the structural details of the first embodiment of the present invention, the application of the first embodiment is outlined hereinafter.

Figure 4:
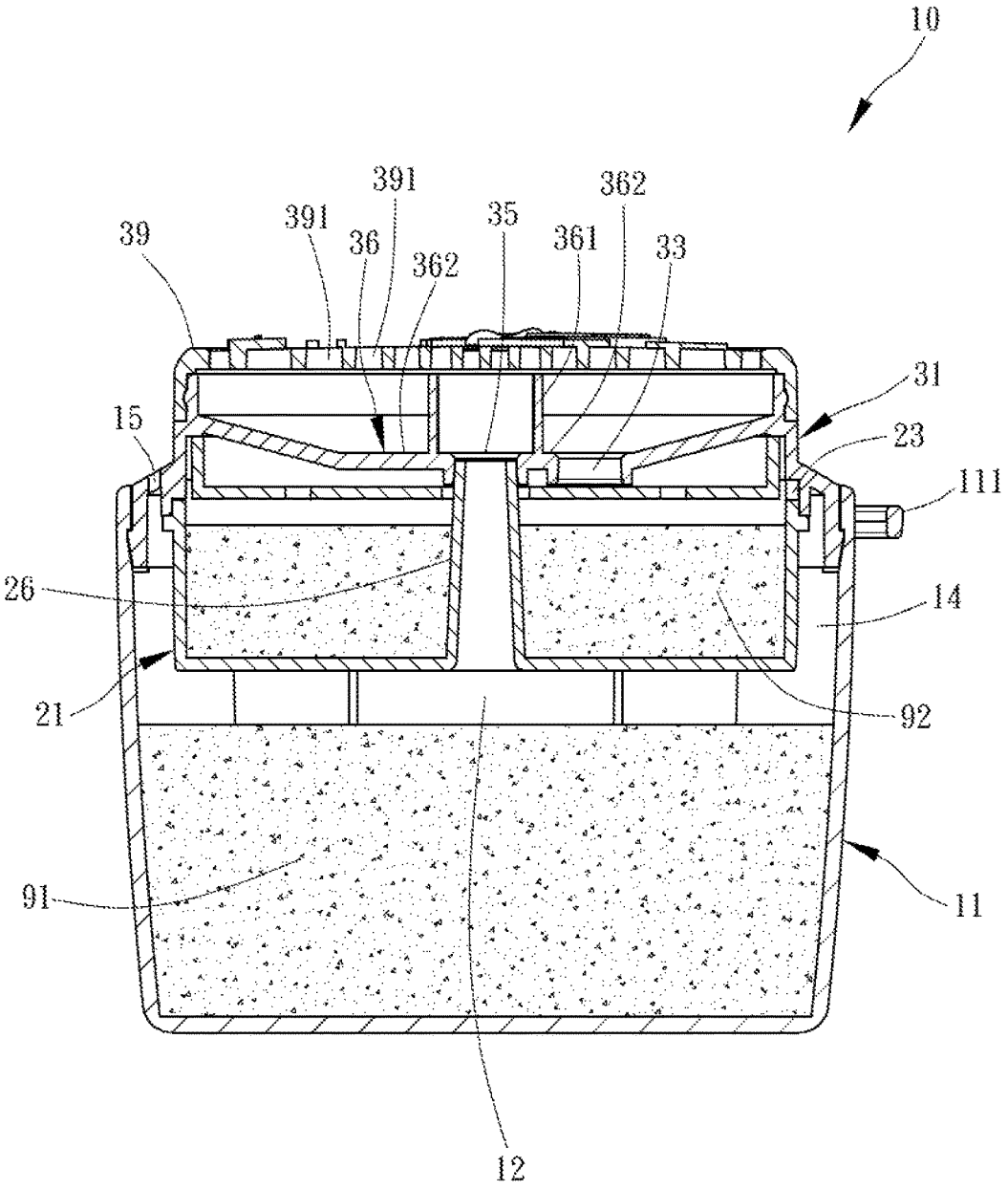
FIG. 4 is a schematic applied view of the first embodiment of the present invention, illustrating a toilet cleaning agent put in the bottom chamber and a fragrance compound put in the inner box.

Referring to FIG. 4, before using the stacked type quantitative toilet cleaning agent dispenser 10, fill a toilet cleaning agent 91 in the bottom chamber 12 and a fragrance compound 92 in the inner box 21. The toilet cleaning agent 91 and the fragrance compound 92 are solid at room temperature. Thus, the stacked type quantitative toilet cleaning agent dispenser 10 can be used in the toilet after the filling of the toilet cleaning agent 91 and the fragrance compound 92.

Figure 5:
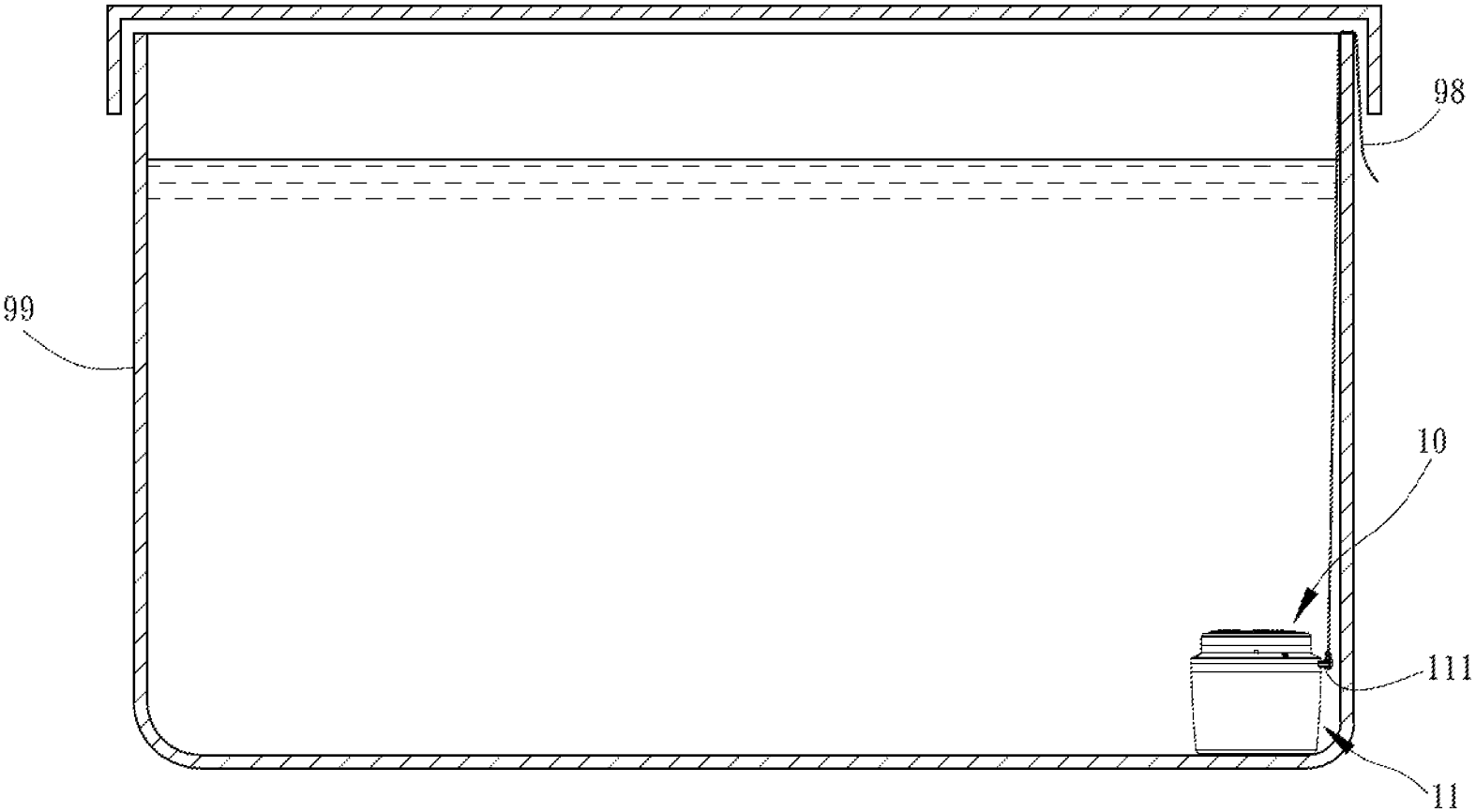
FIG. 5 is another schematic applied view of the first embodiment of the present invention, illustrating the stacked type quantitative toilet cleaning agent dispenser installed in a toilet water tank and a cord member tied to the mounting portion of the housing and extended over the topmost edge of the peripheral wall of the toilet water tank.

Referring to FIG. 5 and FIGS. 1-3 again, in application, put the stacked type quantitative toilet cleaning agent dispenser 10 in the inner bottom side of the toilet water tank 99, and tie a cord member 98 to the mounting portion 111 and extend it over the topmost edge of the peripheral wall of the toilet water tank. Thus, the user can pull the cord member 98 to take the stacked type quantitative toilet cleaning agent dispenser 10 out of the toilet water tank 99. When the toilet water tank 99 is filled up with water and the water level is above the elevation of the stacked type quantitative toilet cleaning agent dispenser 10 in the toilet water tank 99, water will flow through the multiple openings 391 of the decorative lid 39 into the two sub-recesses 362, and then flow through the first water inlet 33 into the inner box 21 and also flow through the second water inlet 35 and the open end tube 26 into the bottom chamber 12. At this time, the fragrance compound 92 in the inner box 21 will be continuously dissolved in water, causing the water in the inner box 21 to be brought to a saturated state. When the water in the inner box 21 is saturated, the fragrance compound 92 is no longer dissolved. At the same time, the toilet cleaning agent 91 in the bottom chamber 12 is also continuously dissolved in water, causing the water in the bottom chamber 12 to be brought to a saturated state. When the water in the bottom chamber 12 is saturated, the toilet cleaning agent 91 is no longer dissolved.

When the user flushes the toilet after use, the water level in the toilet water tank 99 drops to the lower limit position, and then the toilet water tank 99 is filled up with water again. At the time the water level in the toilet water tank 99 drops below the elevation of the first water inlet 33 and the elevation of the second water inlet 35, the saturated fragrance compound solution in the inner box 21 flows out of the housing 11 through the first water outlet 23 into the toilet water tank 99, and the saturated toilet cleaning agent solution in the bottom chamber 12 flows out of the housing 11 through the second water outlet 15 into the toilet water tank 99. After the water level dropped below the elevation of the first water outlet 23 and the elevation of the second water outlet 15, the saturated fragrance compound solution between the first water inlet 33 and the first water outlet 23 continuously flows out till that the water level of the saturated fragrance compound solution drops below the elevation of the first water outlet 23, and the saturated toilet cleaning agent solution between the second water inlet 35 and the second water outlet 15 also continuously flows out till the water level of the saturated toilet cleaning agent solution drops below the elevation of the second water outlet 15. When the toilet water tank 99 is filled up with water again to cause a rise in water level over the topmost edge of the recess 36, the water flows through the first water inlet 33 and the second water inlet 35 into the inner box 21 and the bottom chamber 12 again, causing the fragrance compound 92 and the toilet cleaning agent 91 to be dissolved to the saturated state.

In the process the water flows through the first water inlet 33 and the second water inlet 35, the two sub-recesses 362 of the cover 31 are configured to achieve water separation and guiding effects.

Figure 6:
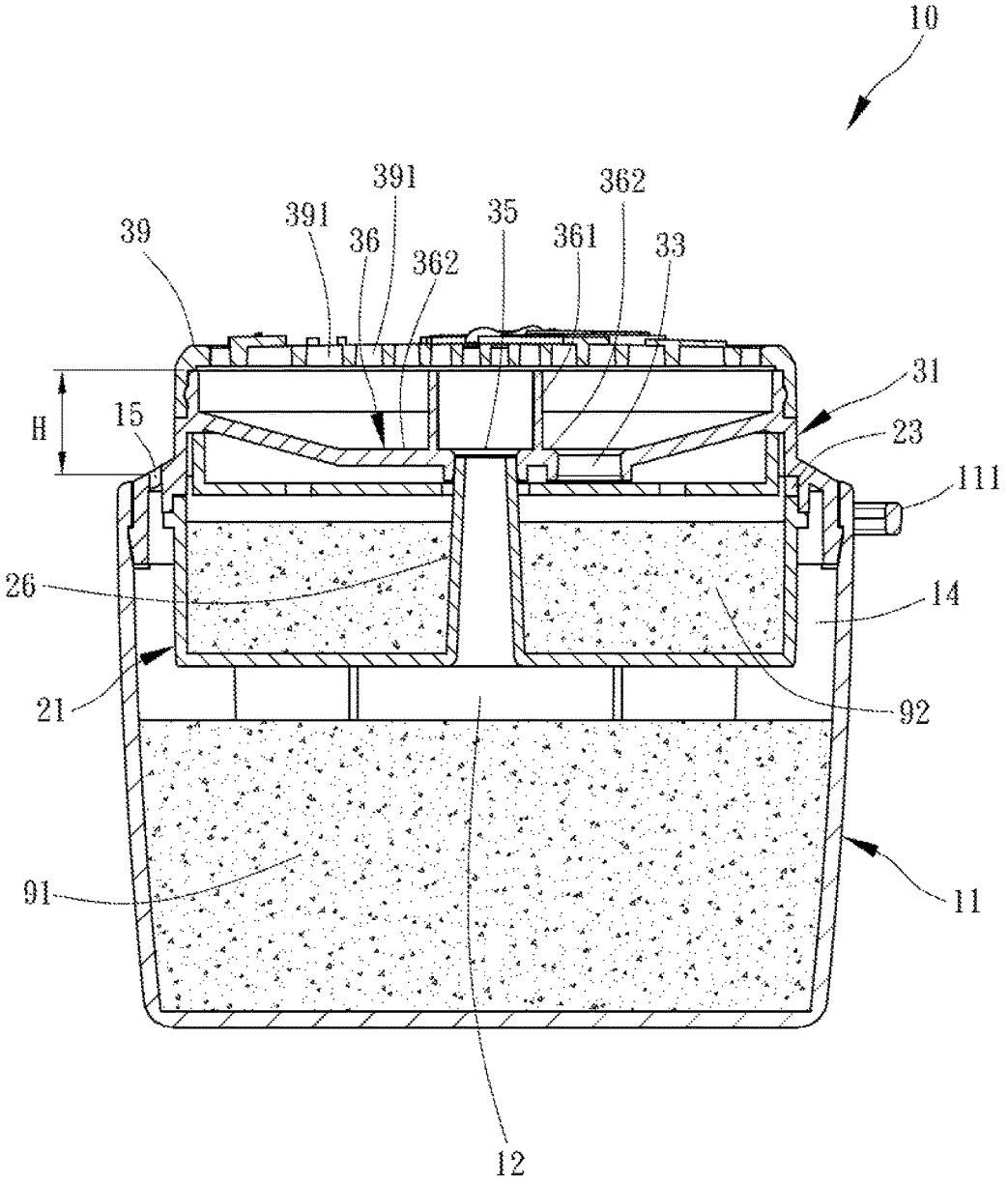
FIG. 6 corresponds to FIG. 4, illustrating the predetermined dispensing amount of saturated toilet cleaning agent solution corresponding to the height difference between the top edge of the recess and the second water outlet.

Referring to FIG. 6, as can be seen from the above description, after every toilet flush, the stacked type quantitative toilet cleaning agent dispenser 10 dispenses a predetermined amount of saturated fragrance compound solution corresponding to the volume of water between the top edge of the recess 36 and the first water outlet 23 and a predetermined amount of saturated toilet cleaning agent solution corresponding to the volume of water between the recess 36 and the second water outlet 15, as the height difference H indicated in FIG. 6 between the top edge of the recess 36 and the second water outlet 15. It can be seen that the invention provides two or more accommodation spaces for the filling of the toilet cleaning agent 91 and other chemicals, enabling each agent or chemical to be dispensed quantitatively.

Figure 7:
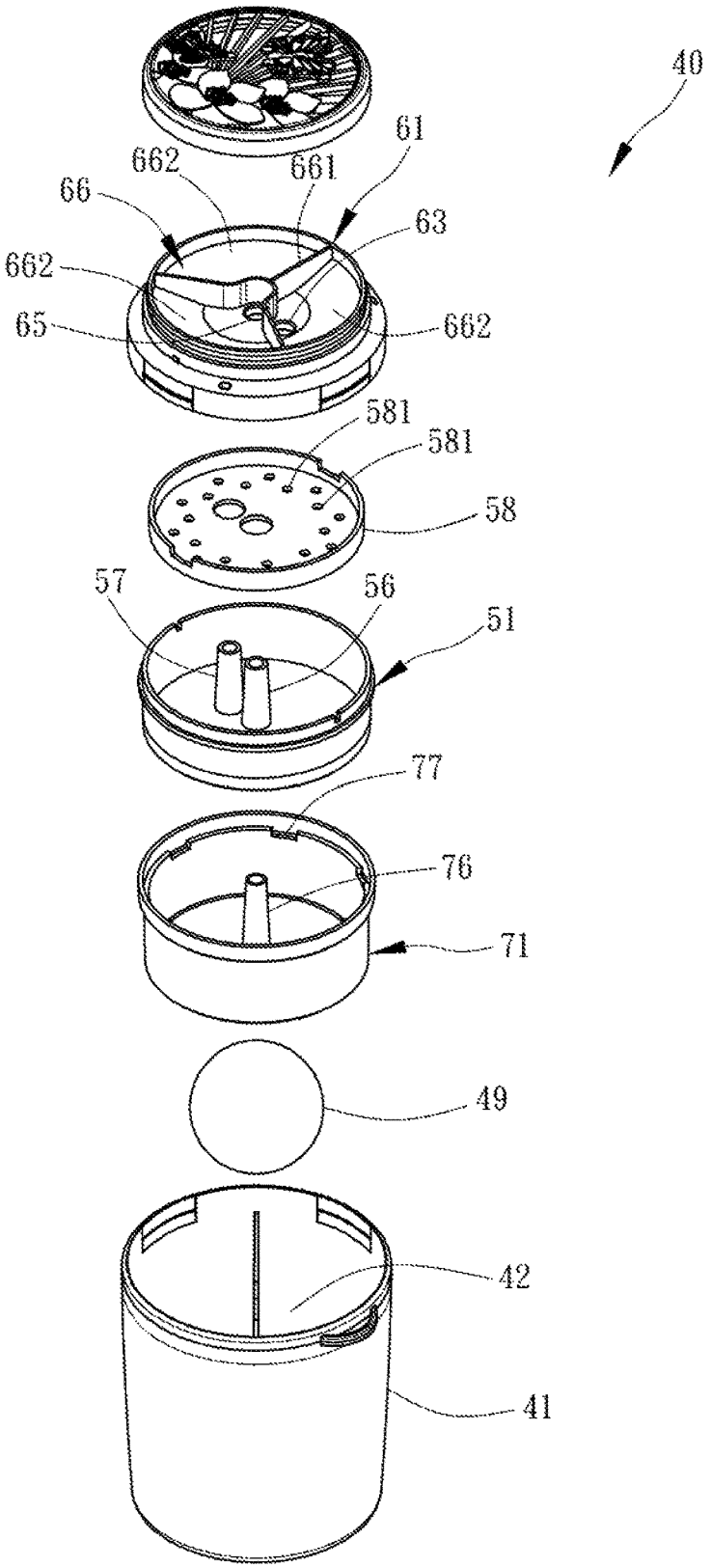
FIG. 7 is an exploded view of a stacked type quantitative toilet cleaning agent dispenser in accordance with a second embodiment of the present invention.
Figure 8:
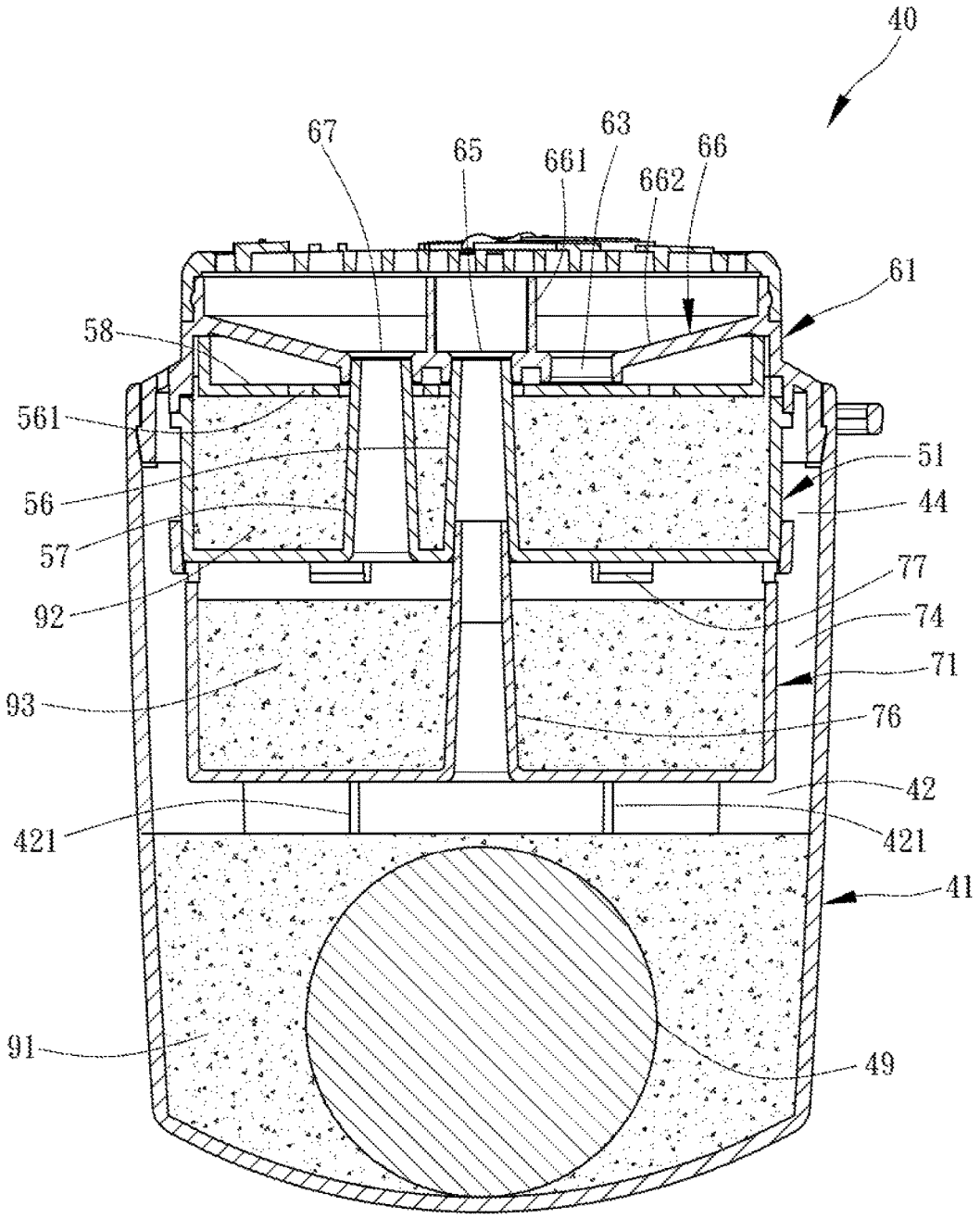
FIG. 8 is a schematic sectional view of the stacked type quantitative toilet cleaning agent dispenser in accordance with the second embodiment of the present invention.

Referring to FIGS. 7 and 8, a stacked type quantitative toilet cleaning agent dispenser 40 in accordance with a second embodiment of the present invention is shown. This second embodiment is substantially similar to the aforesaid first embodiment with the exceptions as follows:

The stacked type quantitative toilet cleaning agent dispenser 40 of this second embodiment further comprises a middle box 71 positioned in the bottom chamber 42 and attached to the bottom side of the inner box 51. The middle box 71 comprises a connection tube 76. The connection tube 76 has one end thereof inserted into the open end tube 56 and kept in communication with the open end tube 56, and an opposite end thereof inserted into the middle box 71 and kept in communication with the bottom chamber 42 so that the second water inlet 65 and the bottom chamber 42 can be kept in communication with each other by means of the open end tube 56 and the connection tube 76 without being disposed in communication with the inner box 51 or the middle box 71. The middle box 71 comprises a third water outlet 77. The third water outlet 77 enables the space inside the middle box 71 to be communicated with the space outside the middle box 71. Further, a middle aisle 74 is defined between the outer perimeter of the middle box 71 and the inner perimeter of the housing 41. In application, a deodorant 93 can be filled in the middle box 71.

The cover 61 comprises a third water inlet 67 located in the bottom side of the recess 66; the partition plate 661 divides the recess 66 into three sub-recesses 662 respectively disposed corresponding to the first water inlet 63, the second water inlet 65 and the third water inlet 67.

The inner box 51 further comprises a second open end tube 57. The second open end tube 57 has one end thereof connected to the cover 61 and disposed in communication with the third water inlet 67, and an opposite end thereof inserted through the inner box 51 and disposed in communication with the middle box 71, and thus, the third water inlet 67 and the middle box 71 are disposed in communication with each other but not kept in communication with the inner box 51. Further, the inner box 51 has a lifting partition plate 58 mounted therein. The lifting partition plate 58 is vertically movably accommodated in the inner box 51 and attached onto the open end tube 56. Further, the lifting partition plate 58 covers over 90% and up of the cross-sectional area of the inner box 51. Further, the lifting partition plate 58 comprises a plurality of through holes 581. The lifting partition plate 58 can cover the fragrance compound 92, enabling the fragrance compound 92 to be kept in contact with water through the through holes 581. Since the fragrance compound 92 is a fast-evaporating substance, the covering of the lifting partition plate 58 reduces the rate of consumption of the fragrance compound 92, allowing the fragrance compound 92 to last longer. Further, since the lifting partition plate 58 is vertically movably accommodated in the inner box 51, the lifting partition plate 58 can be lowered with the consumption of the fragrance compound 92 and kept covered on the fragrance compound 92.

In this second embodiment, the open end tube 56 is shaped like a sweet cone with the inner diameter made gradually increased from the top side toward the bottom side; the connection tube 76 is also shaped like a sweet cone with the inner diameter made gradually increased from the top side toward the bottom side. This conical inner diameter design facilitates alignment and connection between the connection tube 76 and the open end tube 56.

The bottom chamber 42 has a counterweight 49 mounted therein. In the implementation of the present invention, the counterweight 49 can be a glass bead. Further, the bottom wall of the housing 41 is a downwardly curved spherical wall. In order to hold the counterweight 49 in place, the housing 41 is configured to provide a plurality of extension walls 421 protruded from an inner peripheral wall thereof within the bottom chamber 42 and abutted against the counterweight 49 to hold the counterweight 49 at the center of the bottom chamber 42. Subject to the design of the downwardly curved spherical wall of the housing 41 and the arrangement of the counterweight 49 in the bottom chamber 42, the stacked type quantitative toilet cleaning agent dispenser 40 of this second embodiment acts as a tumbler that will not fall down. No matter whether the water level in the toilet water tank 99 rises or drops, the stacked type quantitative toilet cleaning agent dispenser 40 will stand up and rely on the center of gravity for stability. When the stacked type quantitative toilet cleaning agent dispenser 40 shakes due to a change in the buoyancy, the water in the inner box 51, the middle box 71 and the bottom chamber 42 enables the fragrance compound, the deodorant and the toilet cleaning agent to be dissolved more evenly, facilitating formation of the saturated solutions.

In the application of this second embodiment, in addition to the above-described tumbler wobble function, during water intake of the middle box 71, water flows through the third water inlet 67 and the second open end tube 57 into the middle box 71. When dispensing the saturated deodorant solution, it is dispensed through the third water outlet 77 to the middle aisle 74 and then the aisle 44 toward the outside of the housing 41. Thus, a predetermined amount of saturated deodorant solution is dispensed corresponding to the volume of water between the top edge of the recess 66 and the third water outlet 77. When filling water into the bottom chamber 42, water flows from the first water inlet 63 through the open end tube 56 and the connection tube 76 into the bottom chamber 42.

The other structural details of this second embodiment and the effect this second embodiment can achieve are same as the aforesaid first embodiment, and thus, we will not repeat them here.

What is claimed is:

1. A stacked type quantitative toilet cleaning agent dispenser, comprising:

a housing having an arcuate sidewall, an open top side, and an opposing closed bottom side for positioning on a surface;

an inner box mounted in said housing such that a bottom chamber is defined within said housing between an outer bottom surface of said inner box and an inner bottom surface of said housing and an aisle is defined between an inner perimeter of said housing and an outer perimeter of said inner box and disposed in communication with said bottom chamber; and a cover covering said inner box with a top of said cover exposed on the outside of said housing, said cover comprising a first water inlet and a second water inlet, said first water inlet being disposed in communication with a space inside said inner box;

wherein:

said inner box comprises an open end tube, said open end tube having a first end connected to said cover and disposed in communication with said second water inlet and an opposite end inserted through said inner box and disposed in communication with said bottom chamber to keep said second water inlet and said bottom chamber in communication with each other and to isolate said second water inlet and said bottom chamber from said inner box;

the stacked type quantitative toilet cleaning agent dispenser further comprises a first water outlet located in said cover for allowing communication between a space inside said inner box and the space outside said inner box, said first water outlet being disposed below a elevation of said first water inlet;

said cover covers the said open top side of said housing; a second water outlet is located in said cover; for allowing communication between a space outside said housing and said aisle, said second water outlet being disposed below a elevation of said second water inlet.

2. The stacked type quantitative toilet cleaning agent dispenser as claimed in claim 1, wherein said cover further comprises a recess inwardly sloped from a top surface of said cover; said first water inlet and said second water inlet are respectively located in a bottom wall of said recess.

3. The stacked type quantitative toilet cleaning agent dispenser as claimed in claim 2, wherein said cover further comprises a partition plate located on the top surface of said cover and dividing said recess into two sub-recesses, said two sub-recesses being isolated from each other and corresponding to said first water inlet and said second water inlet, respectively.

4. The stacked type quantitative toilet cleaning agent dispenser as claimed in claim 1, wherein said first water outlet extends through said cover.

5. The stacked type quantitative toilet cleaning agent dispenser as claimed in claim 1, wherein said open end tube is shaped like a cone, having an inner diameter which increases from the first end toward the opposite end.

6. The stacked type quantitative toilet cleaning agent dispenser as claimed in claim 1, further comprising a lifting partition plate vertically movably mounted in said inner box and attached to said open end tube, said lifting partition plate covering at least 90% of the cross-sectional area of said inner box, said lifting partition plate comprising a plurality of through holes.

7. The stacked type quantitative toilet cleaning agent dispenser as claimed in claim 1, further comprising a decorative lid covering said cover, said decorative lid comprising a plurality of openings.

8. The stacked type quantitative toilet cleaning agent dispenser as claimed in claim 7, wherein said cover covers said inner box and said housing.

9. The stacked type quantitative toilet cleaning agent dispenser as claimed in claim 1, wherein said housing comprises a mounting portion located at a perpihery.

10. The stacked type quantitative toilet cleaning agent dispenser as claimed in claim 1, wherein said opposing closed bottom side is a curved wall, and a counterweight accommodated in said bottom chamber and supported on said curved wall.

11. The stacked type quantitative toilet cleaning agent dispenser as claimed in claim 10, wherein said housing further comprises a plurality of extension walls protruding inwardly from an inner surface of the bottom chamber, the plurality of extensions walls abutting against said counterweight to hold said counterweight in place.

12. The stacked type quantitative toilet cleaning agent dispenser as claimed in claim 1, further comprising a middle box mounted in said bottom chamber and attached to a bottom wall of said inner box, said middle box comprising a connection tube, said connection tube having a first end inserted into said open end tube and disposed in communication with said open end tube and an opposite end inserted through said middle box and kept in communication with said bottom chamber so that said second water inlet and said bottom chamber are kept in communication with each other via said open end tube and said connection tube and isolated from said inner box and said middle box; said middle box further comprises a third water outlet to keep a space inside said middle box being in communication with the space outside said middle box; said middle box has an outer perimeter which with the inner perimeter of said housing, defines a middle aisle therebetween; said cover further comprises a third water inlet; said inner box further comprises a second open end tube, said second open end tube having a first end connected to said cover and disposed in communication with said third water inlet and an opposite end inserted through said inner box and kept in communication with said middle box so that said third water inlet and said middle box are kept in communication with each other and isolated from said inner box.

13. The stacked type quantitative toilet cleaning agent dispenser as claimed in claim 12, wherein said cover further comprises a recess inwardly sloped from a top surface of said cover; said first water inlet, said second water inlet and said third water inlet are located in a bottom wall of said recess.

14. The stacked type quantitative toilet cleaning agent dispenser as claimed in claim 13, wherein said cover further comprises a partition plate located on the top surface of said cover and dividing said recess into three sub-recesses, said three sub-recesses being isolated from one another and corresponding to said first water inlet, said second water inlet and said third water inlet, respectively.

* * * * *